United States Patent [19]

Ruggeri

[11] Patent Number: 4,647,101

[45] Date of Patent: Mar. 3, 1987

[54] ASSEMBLABLE FREIGHT WAGON

[76] Inventor: Guido Ruggeri, Schubertstrasse 22, 7505 Ettlingen, Fed. Rep. of Germany

[21] Appl. No.: 728,237

[22] Filed: Apr. 29, 1985

[30] Foreign Application Priority Data

May 1, 1984 [GB] United Kingdom ..... 841135

[51] Int. Cl.[4] ..... B60P 3/42

[52] U.S. Cl. ..... 296/10; 296/181; 105/363; 105/404

[58] Field of Search ..... 296/10, 181, 183; 105/238 R, 355, 363, 396, 404, 418; 220/40

[56] References Cited

U.S. PATENT DOCUMENTS

| | | | |
|---|---|---|---|
| 1,398,386 | 11/1921 | McRae | 105/363 |
| 2,461,577 | 2/1949 | Stark, Jr. | 296/10 |
| 2,761,581 | 9/1956 | Cohee | 105/363 |
| 3,252,730 | 5/1966 | Chieger et al. | 296/181 |

FOREIGN PATENT DOCUMENTS

| | | | |
|---|---|---|---|
| 658861 | 3/1963 | Canada | 105/363 |

*Primary Examiner*—Robert R. Song

*Attorney, Agent, or Firm*—Willian Brinks Olds Hofer Gilson & Lione Ltd.

[57] ABSTRACT

A freight wagon is assembled from a set of building blocks together forming a superstructure mounted on a skeletal underframe having at least one axial beam and an upper surface with a modular bearing pattern. The building blocks are selected from a set of building blocks of corresponding modular dimensions, there being a plurality of species of building blocks and sets of congruent building blocks of each species whereby the underframe is usable with alternative superstructures for carrying alternative types of goods and which alternative superstructures are assemblable from alternative selections and combinations of building blocks. The wagon is particularly useful as a railway wagon in a system of wagons having bearing patterns which are unified in the sense that the modular dimensions are the same although not necessarily having the same number of modules. The wagon is assembled using simple slotted joints for automated assembly.

15 Claims, 11 Drawing Figures

Figure 1:
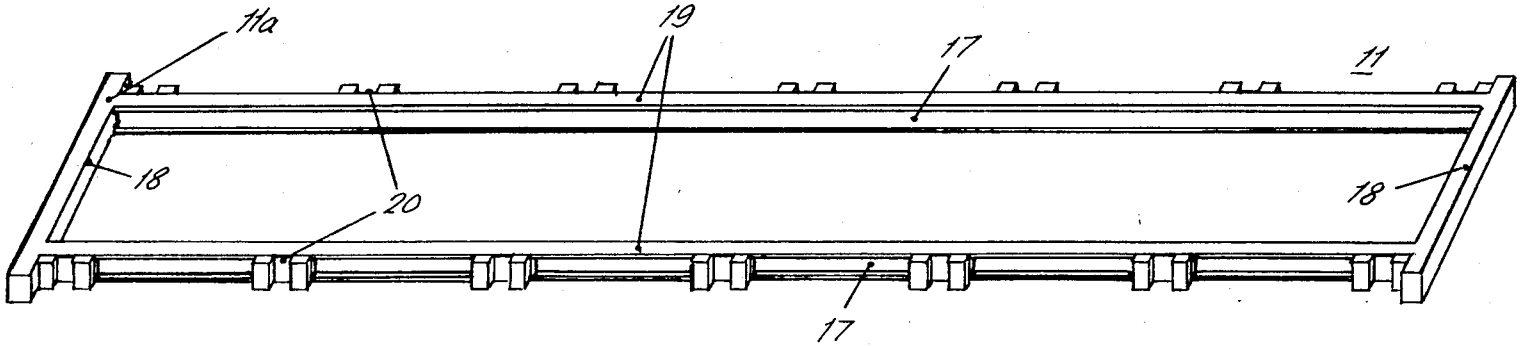

13
34
13b
37
12
33
20
21
36
19
24
30
12c
37
37
36
28
29
28
29
35
33
19
17
12
17
33
20
12c
21
30
11
24

ASSEMBLABLE FREIGHT WAGON

This invention relates to an assemblable freight wagon, and in particular but not exclusively to an assemblable railway freight wagon.

It is known that to carry goods special wagons of different shapes are used according to the nature of the transported merchandise.

The particular shape of every wagon's model is determined by its operating requirements: goods protection, good stowage, loading and unloading easiness and swiftness.

Whilst specialised wagons are easier to use they tend to be under utilised because they cannot be used for other goods on return journeys for example which results in such wagons making unloaded journeys.

The low utilization of their wagons and the high percentage of unloaded trips are certainly major causes of losses for railway operating organisations, because of the parking and maintenance costs of a large and underused rolling stock. On the other hand, if a rolling railway operating organization is not able to deliver at short notice the requested wagon, the client turns to other means of transport, which results in the organisation having still lower utilization of its rolling stock.

The introduction of new transport techniques, such as containers, swap bodies or the ferry of lorries and semi-trailers, has simplified the job to the users in many cases, but for the railway operating organizations this means only new models of special purpose wagons, facing the same problems previously seen.

The usefulness of wagons which could be fitted for more than one kind of loads has been longfelt, mainly for convertible flat cars.

The U.S. Pat. No. 1,478,831 (Long) relates to a flat wagon equipped with perimetral vertical guides where different types of side and end panels can be inserted to fit said wagon to a particular farm product. A similar arrangement is proposed by the Belgian Pat. No. 499,630 (Hedberg and Stahl) for a flat wagon which can be transformed in a covered one, inserting in similar guides some panels fitting together to form its walls and completing it with other panels forming its roof.

The U.S. Pat. No. 1,344,243 (Ovarec) relates to some side and end walls which can be connected and disconnected to a flat car. The U.S. Pat. No. 2,826,156 (Hall) is related to a removable attachment for positioning across the end of a flat car. The U.S. Pat. No. 2,949,867 (Ramsey) relates to a shelter formed by some parts joined among them on a flat car; said shelter is assembled after the loading and disassembled before the unloading, so providing a structure transforming a flat car in something like a covered wagon. The U.S. Pat. No. 3,358,616 (Brodhead) relates to a plurality of bulk commodities wagons implemented by putting on a flat car different pairs of top and bottom parts, each of which forms an enclosed structure, when in a first position, and nests one into the other when in the other one, providing also said car and said top and bottom parts all the necessary means to be connected each one to the others and to charge and discharge the commodities.

A completely different approach is proposed by the U.S. Pat. No. 2,250,535 (Krassler), which relates to a wagon which can be used as a gondola, as a covered gondola and as a box car; substantially it is a gondola car providing a strengthened upper border which can support a removable roof; to transform it into a box car, some pieces of its structure are to be removed, cutting the rivets connecting them to the body, so opening two lateral central ports in its sides where, joining and riveting some other pieces forming two frameworks, two doors can be placed; the opposite transformation has to be made when a box car is reshaped as a gondola car.

Another approach is outlined in the Austrian Pat. No. 335,507 (Kassbohrer Fahrzeugwerke) relating to a wagon's underframe fit to carry containers and the like and providing air powered handling gear adapted to perform the loading and unloading operations of such bodies without external equipment.

The same problem is also felt for the lorries and semi-trailers. The U.S. Pat. No. 3,155,419 (Garson) relates to a removable set of side panels permanently connected to a semi-trailer and the like, which can be either folded at the front end of its floor, so shaping a flat bed semi-trailer, or opened, so shaping a row of adjoining doors providing the side and rear walls of a covered van. The U.S. Pat. No. 3,837,702 (Case) relates to an assemblable timber structure, aimed at the flat bed trailers carrying steel and the like, formed by vertical stakes fitting in holes cut in its floor and providing vertical grooves housing closing panels. Both structures can support an upper framework and a tarpaulin cover.

The usefulness of transport vehicles adaptable to particular goods in present in other fields too; for instance the German Pat. No. 1,536,120 (Konigstein) relates to a farm products container formed by six disjoint pieces fitting among them and strengthened by external ties, which can shape some different structures and can be mounted in different ways on different underframes.

None of the listed patents are aimed at or can provide a structure which can be fitted together in different ways so as to form the various types of widely used specialised freight wagons.

An object of the invention is to provide a assemblable freight wagon which continues the advantages of multipurpose use with those of specialised adaptation.

According to the present invention an assemblable freight wagon for use in a system of wagons, comprises in use when assembled (a) a skeletal underframe, (b) Coupling gear and wheeled running gear fitted to said underframe, (c) a superstructure removably mounted on said underframe and adapted for carrying a specific type of goods, (d) said underframe including at least one axial beam, (e) a horizontal upper surface of said underframe defining a modular bearing pattern which is unified with respect to other wagons of said system of wagons in the sense that the modular dimensions, but not necessarily the number of modules per wagon, are the same, and (f) an assembly of building blocks together comprising said supeerstructure and selected from a set of building blocks of corresponding modular dimensions there being a plurality of species of building blocks and sets of congruent building blocks of each species, whereby the underframe is usable with alternative superstructures adapted for carrying alternative types of goods and which alternative superstructure are assemblable from alternative selections and combinations of building blocks.

An advantage of such a wagon is that the skeletal underframe is capable of supporting a diverse range of superstructures and does not suffer from the limitations in this respect experienced using a flat bed type of underframe.

A further advantage is that the modular approach enables the same building blocks to be used with underframes having different numbers of modules and that in a given wagon different modular portions can be adapted for carrying different goods.

Preferably the set from which the building blocks are selected includes a range of alternative modular cross supports, carrying elements, side panels, end panels, end elements and of roof panels.

Such types of building blocks will always perform the same function in any combination of blocks so that their individual construction can be suited to the stresses and loadings required in that application.

Preferably the underframe includes pairs of vertical guides spaced longitudinally at modular pitch and each cross support includes a beam adapted to rest transversely on the underframe and further includes two depending extensions mating with the paired vertical guides on opposite sides of the underframe such that the cross supports and the underframe are brought into and out of engagement with one another by vertical relative movement.

The simplicity of assembly provided by this arrangement is particularly advantageous where automatic systems are to be employed for assembly and disassembly.

Conveniently the depending extensions are profiled to facilitate insertion into the guides, this being particularly advantageous where automated assembly is employed.

Preferably the wagon includes locking means operative between the extensions and the underframe as a safety measure to prevent separation in use.

Advantageously the cross supports embody a beam of enlarged reverse T cross section and rectangular vertical flat end plates, and provide also, at least at one end a vertical H-beam standard.

Alternatively the cross support may be without a vertical standard.

Preferably the carrying elements are structures of a particular shape adapted for carrying a particular load and transferring its weight directly to the underframe, the carrying elements having lower bearing surfaces mating with the upper bearing surface of the underframe and two tapered depending flanges for each module of their length adapted to position and secure them both transversely against the underframe and axially against the outer surfaces of adjoining pairs of guides.

Conveniently the carrying element is provided with fitting means to mate with corresponding support means of the cross supports.

In a preferred embodiment said carrying element is a floor element, basically a rectangular platform normally a module long, providing along each outer border a profiled extension whereupon side panels can be fitted and along each inner border a profiled flange adapted to overlap with laterally reduced parts of beams of cross supports.

Preferably the side panels are structures at least one module long shaped in a particular adaptation, being locked to carrying elements linking them to cross supports, providing parallel to their lower inner border a profiled groove adapted to mate with the profiled extensions of said carrying elements and at its ends two rectangular vertical flat plates each mating with a half plate of said cross supports and also providing, if more than one module long, for each intermediate cross support, which they rest on, a similar plate mating with the end plates of said cross supports, embodying in each pair of said mating plates means adapted to house a locking device, to thereby provide a locking means.

Advantageously said side panels provide, along their vertical outer borders, grooves adapted to be fitted on half standards of the cross supports.

Preferably the end panels are transverse structures shaped for a particular adaptation locked to a cross support, providing along their inner outer borders grooves adapted to be fitted on standards of cross supports and providing also vertical rectangular flat plates mating with half end plates of said cross supports and embodying in each pair of said plates means adapted to house a locking device.

Preferably the end elements are transverse structures forming an end of the wagon and differently shaped according to its model, embodying in said end element the merged fundamental features of a cross support and an end panel fitted on it, so providing a lower bearing surface and depending extensions, respectively mating with the upper bearing surface and a pair of guides of said underframe, lateral plates mating with the end plates of side panels, embodying in each pair of said plates means adapted to house a locking device, and mostly providing also parallel to their inner outer borders, vertical profiled extensions mating with grooves of the side panels.

Conveniently said roof panels are covers shaped for a particular adaptation, placed and locked with known tecniques.

Preferbly all the reversible joints and reversible fittings provide bevelled profiles to facilitate their insertion and whose assembling and disassembling operations follow an ordered sequence of one axis movements adapted to be performed easily by automated systems.

Conveniently all said building blocks are normally standardized so as to be mass produced.

The advantages of such a freight wagon are that, in the case of a railway freight wagon for example, it greatly increases rolling stock utilization so enabling the numbers of rolling stock in a system to be reduced with consequent reductions in operating costs:

- it allows a greater specialisation of the rolling stock and, with low investments, its development according to the market trends;
- it greatly cuts the traffic of unloaded wagons, needing a smaller number of trains to carry the same amount of goods, so getting even better management profitablility;
- it greatly increases the flexibility of the railway system therefore improving competitiveness relative to other transport means, especially road transport.

Another advantage of this invention is a consequence of using modular elements each of which is adapted to be used as a building block in several models so that on the whole, it is necessary to store smaller quantities of pieces for the same number of operating wagons, while it is also possible to produce them by mass production, thereby greatly cutting their cost.

Another advantage is that by using modular units it is possible to realise a freight wagon simultaneously suitable for the transport of goods of different characteristics by dividing it in parts each of which shaped to house a different kind of goods.

Another advantage is that the design of the elements of the structure is such that they can be assembled, disassembled and stored with easily performed operations which can be carried out by automated systems.

The functional and structureal characteristics and the advantages of a freight wagon implemented according to this invention will be made clear by the description and by the annexed drawings referring to details and instances of different shapes of said wagon.

Figure 2:
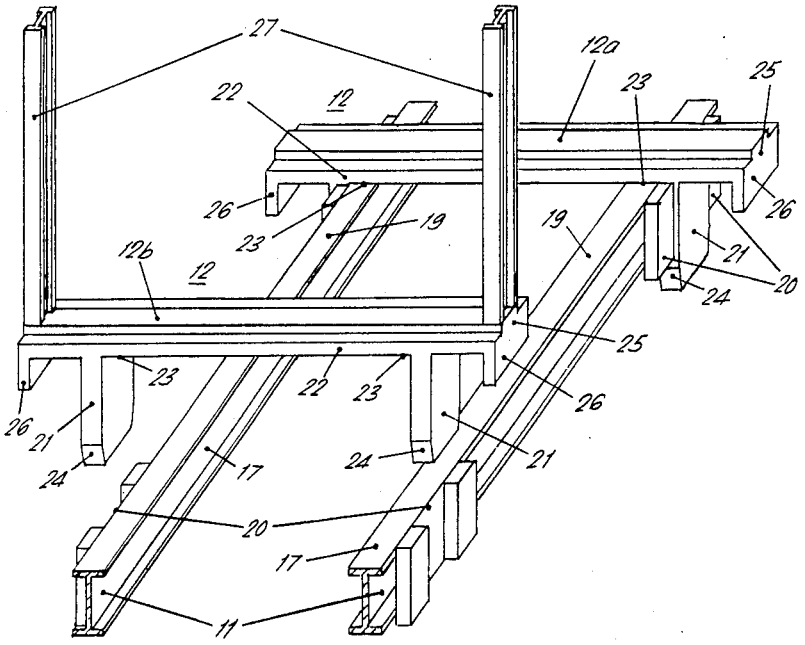
Figure 3:
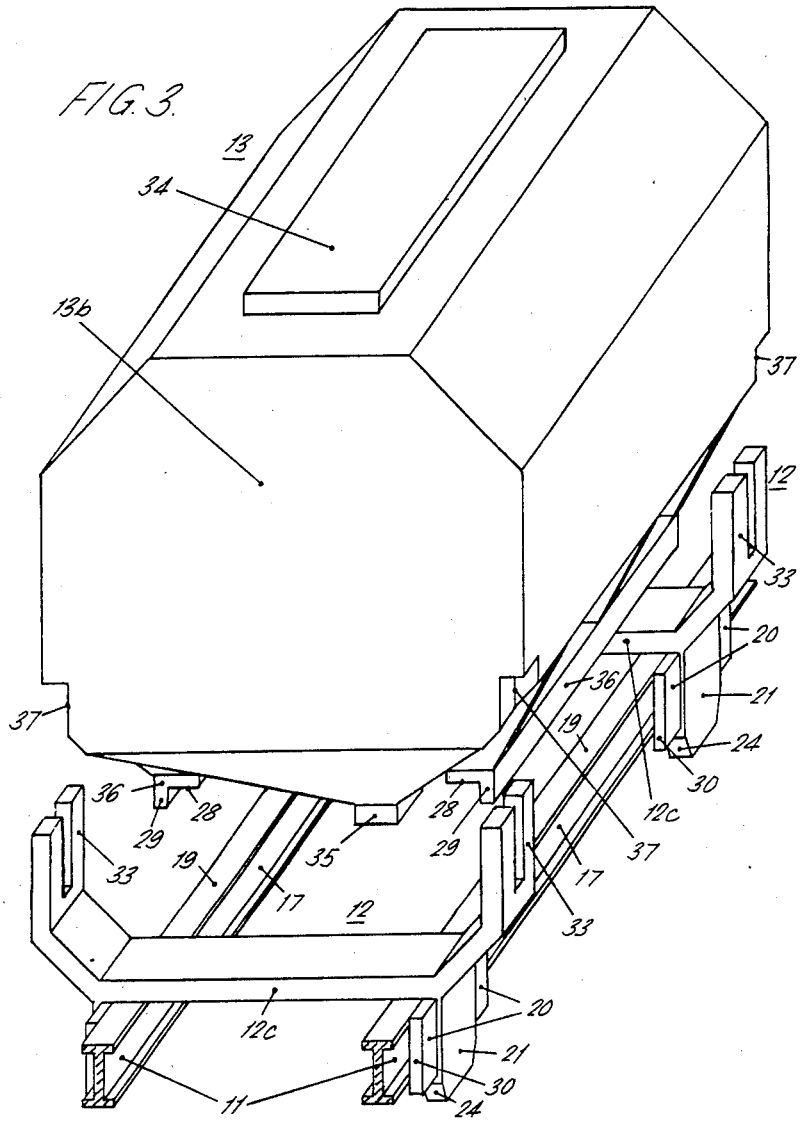
Figure 4:
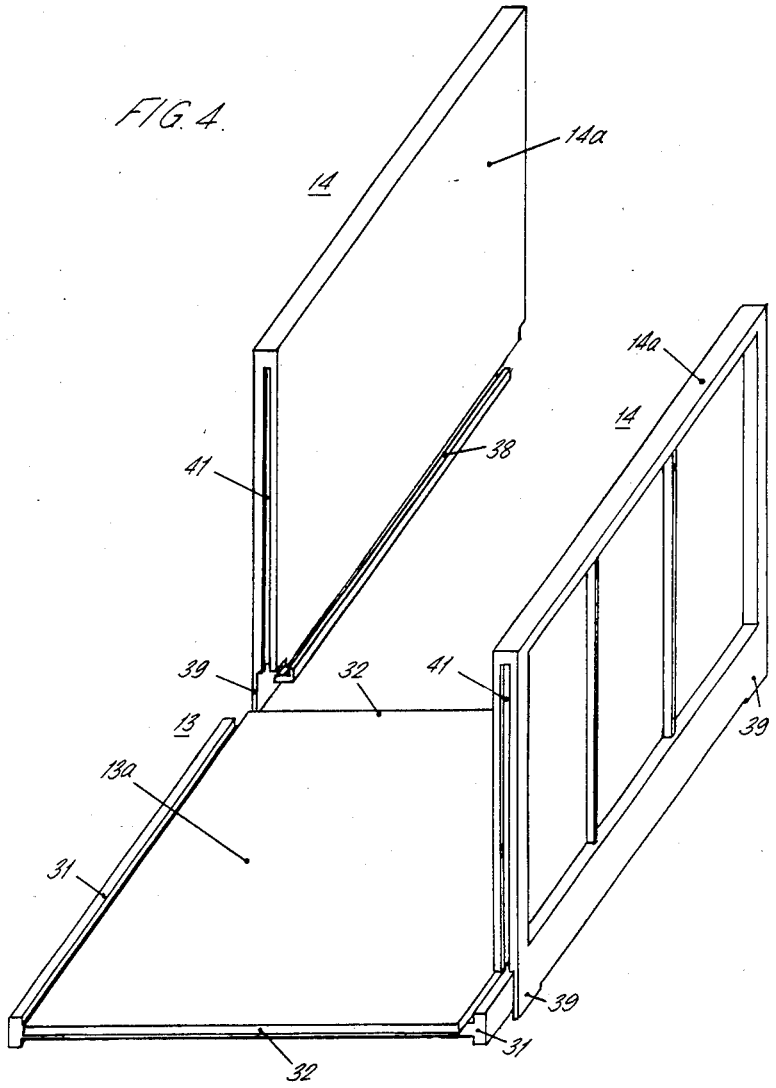
Figure 5:
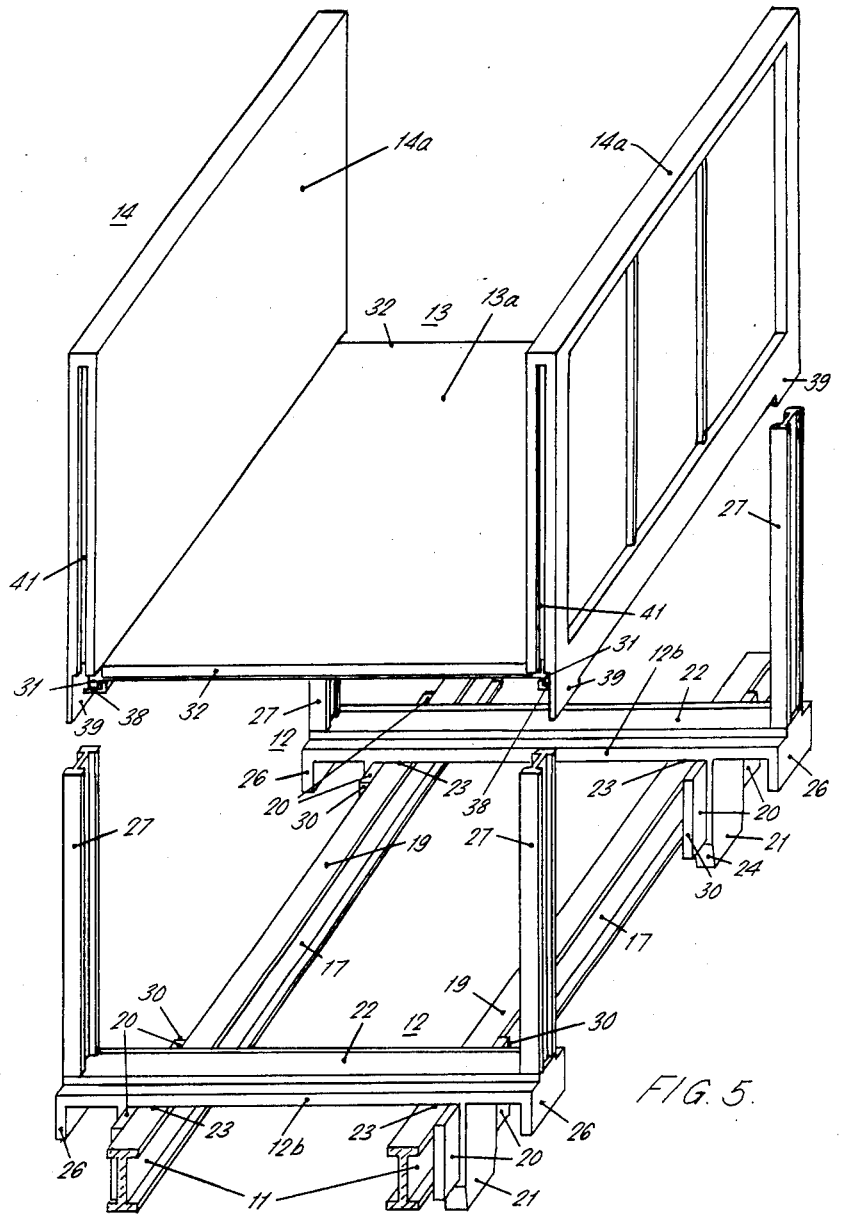
Figure 6:
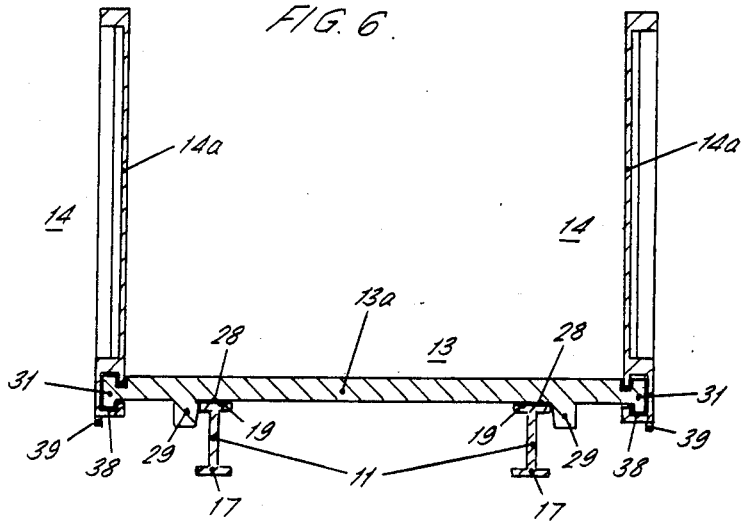
Figure 7:
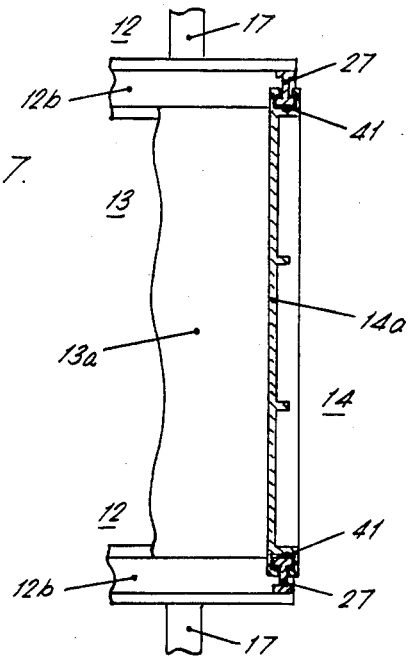
Figure 8:
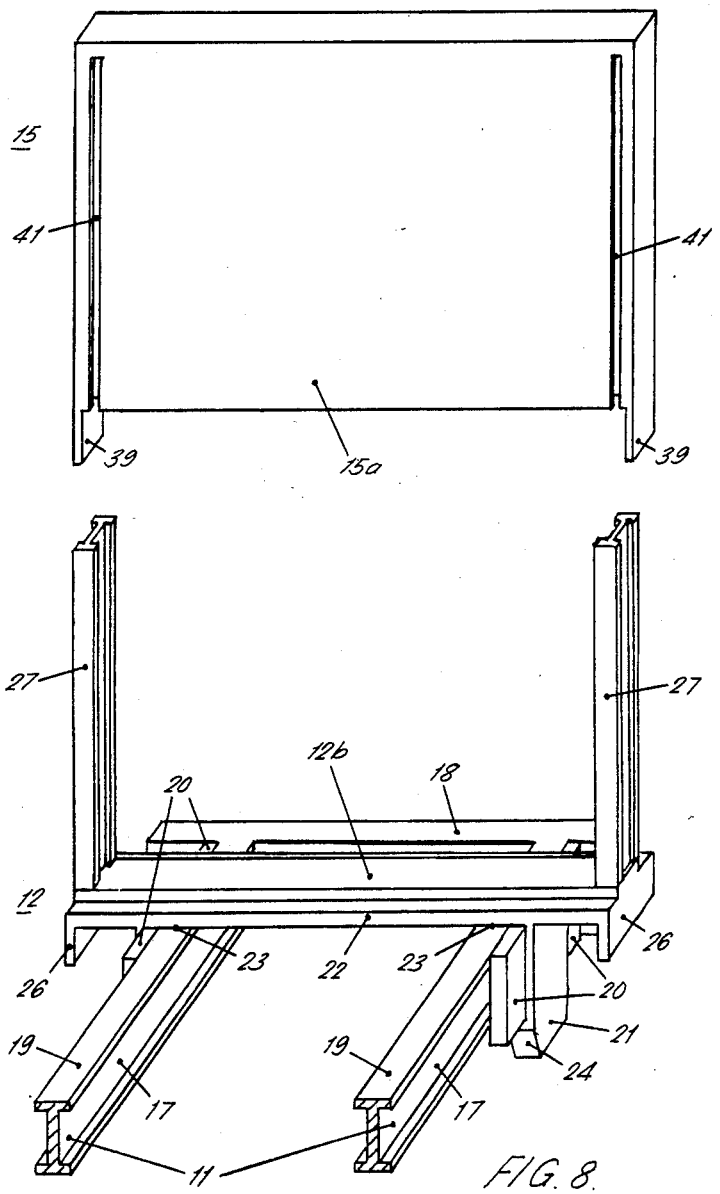
Figure 9:
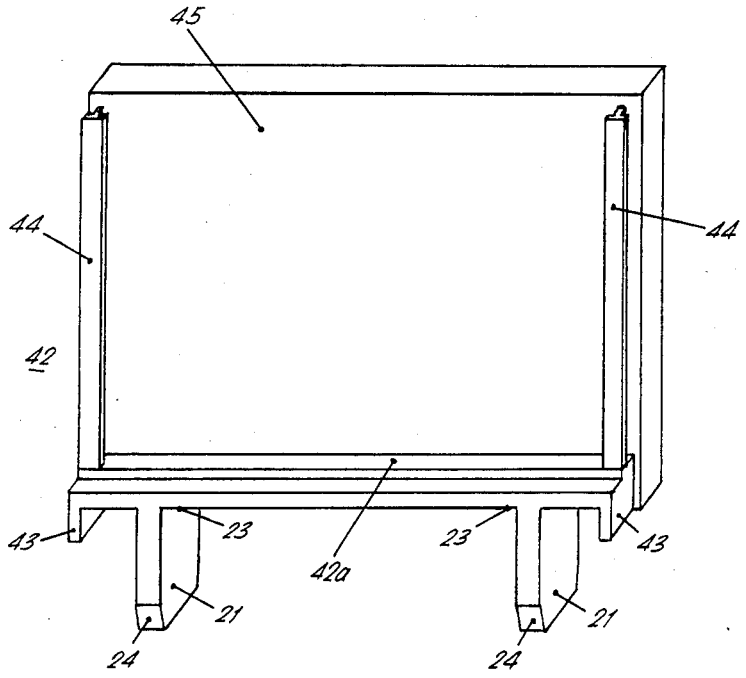
Figure 10:
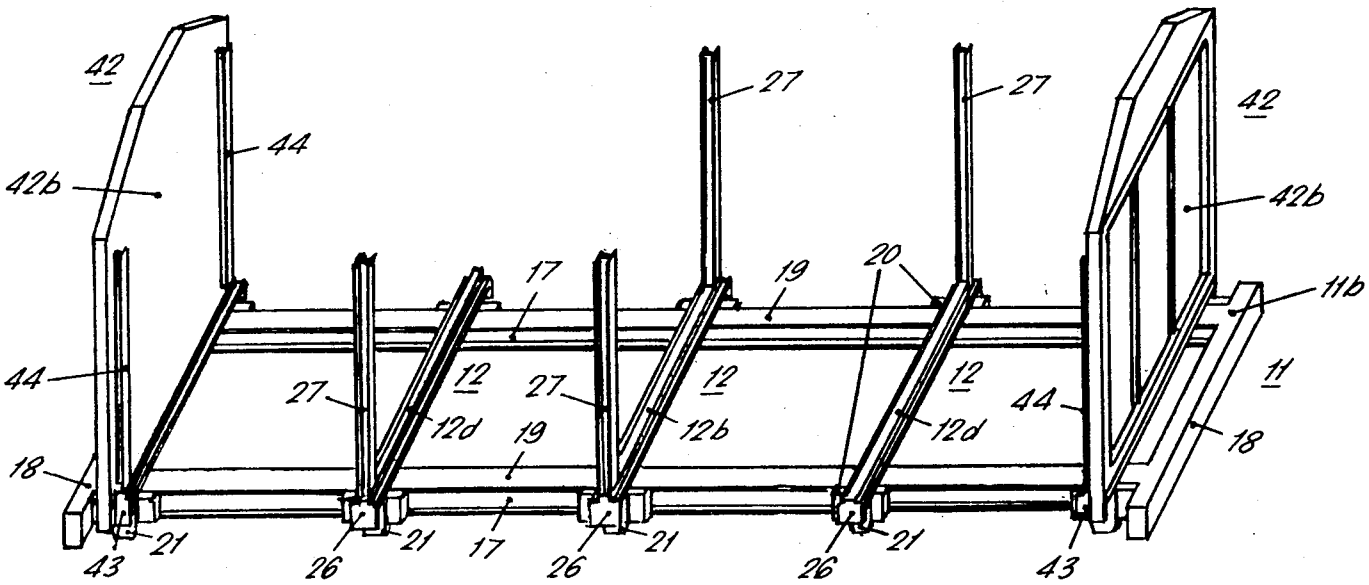
Figure 11:
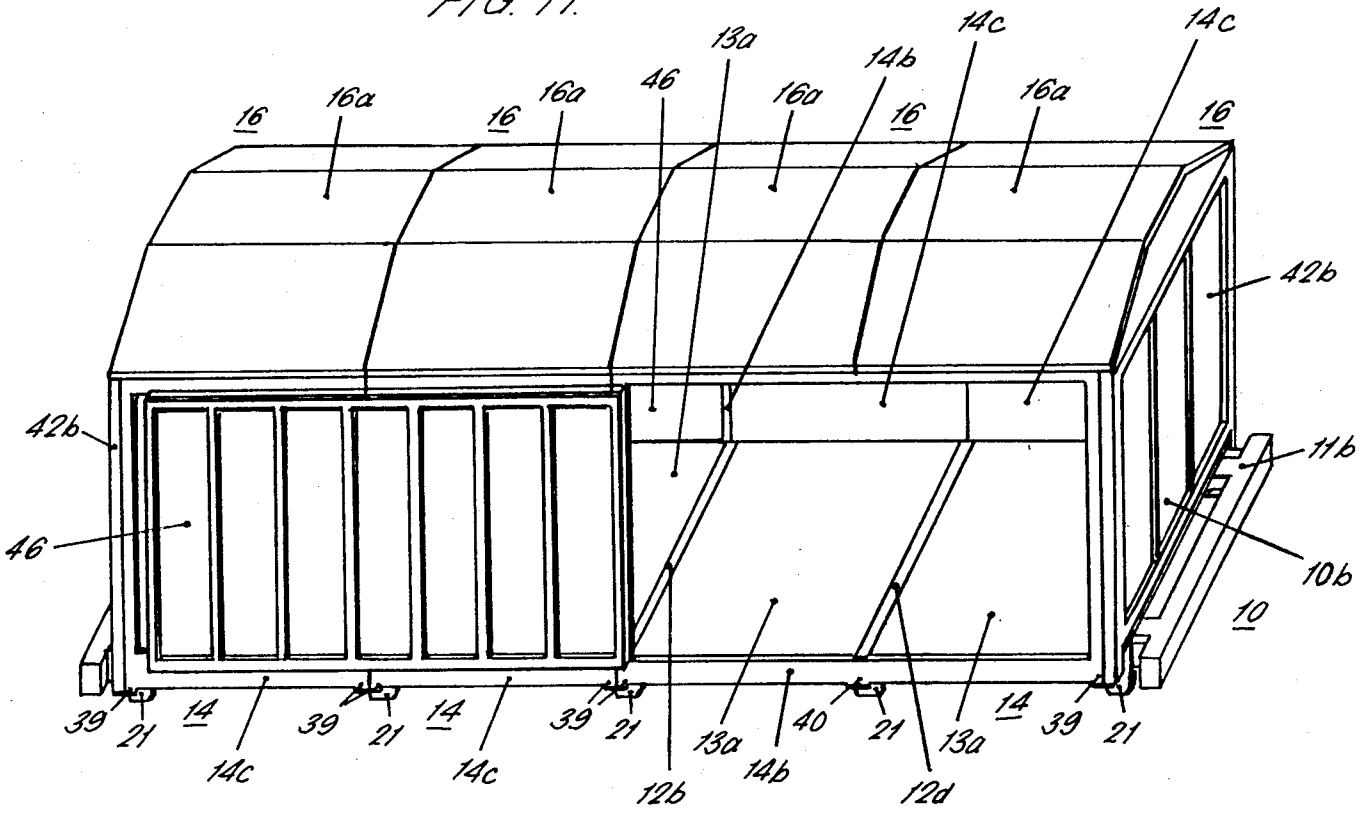

The FIG. 1 shows a perspective view of an underframe of a railway freightwagon according to this invention, The FIG. 2 shows a perspective view of two cross supports of different models, one placed on an underframe, the other ready to be placed, The FIG. 3 shows a perspective view of a carrying element ready to be placed on an underframe bearing two cross supports, The FIG. 4 shows a perspective view of two side panels during their fitting on a flat bed carrying element, The FIG. 5 shows a perspective view of the assembled set of FIG. 4 ready to be placed on an underframe bearing two cross supports providing vertical profiled standards, The FIG. 6 shows a cross section of the assembled set of FIG. 4 placed on an underframe, The FIG. 7 shows a horizontal section of part of the same set of FIG. 6, The FIG. 8 shows a perspective view of an end panel ready to be fitted on a cross support placed on an underframe, The FIG. 9 shows a perspective view of an end wall formed by the permanent connection of a cross support and an end panel, The FIG. 10 shows a perspective view of a four modules underframe bearing the holding frame of a covered wagon with sliding walls, and The FIG. 11 shows a perspective view of the same covered wagon.

More precisely, an assemblable freight wagon marked 10 as a whole embodies: an underframe 11, a holding frame normally formed by two or more cross supports 12, one or more carrying elements 13 and, in most models, also closing panels, which can be side panels 14, end panels 15 and roof panels 16.

Said underframe 11 is formed by at least one axial beam 17 and, sometimes, cross beams 18 generally at its ends; it is so sized as to transfer to each axle the appropriate loading and to take the required traction and compression stresses; it is overslung on wheels, through axle or bogies, and it is equipped with coupling gear including brakes pipes, cables and so on, necessary for coupling to a train.

Throughout the railway system in which such wagons are used, the underframes 11 are to be standardized on a modular base meeting two requirements:

- their upper surface must provide a unified bearing pattern 19 normally lying in a horizontal plane;
- along them, at modular pitch according to a unified pattern, must be placed pairs of vertical guides 20, equally sized and shaped in every underframe 11; said guides 20 must be such as to accommodate the reversible joint of mating guides 21 provided by cross supports 12 and strong enough to withstand the thrusts applied to them.

In the particular example shown in FIG. 1, a six modules underframe 11a is formed by two H-beams 17 and two cross beams 18, laid out as normally used for European wagons; to make things clearer, in this figure, and in all the following ones, all features not directly relevant to this invention are omitted. Said underframe **11*a* provides an upper bearing surface 19 formed by the upper side of the two H-beams 17 and seven pairs of vertical guides 20** which are grooves of rectangular cross section opened on one of their major sides.

The holding frame is formed by some cross supports 12, sometimes completed by axial and cross upper links, which are only strengthening elements fitted on said cross supports and are only marginally related to this invention and therefore are never shown in the figures.

A cross support 12 is basically formed by a beam 22 adapted to rest transversally on an underframe 11, providing said beam 22 a lower surface 23 and two depending profiled extensions 21, ending with a bevelled surface 24 adapted to facilitate their insertion, mating respectively with the bearing surface 19 and one of the pairs of guides 20 of said underframe; said profiled extensions are provided with locking means as a safety device for locking them to the underframe to prevent unwanted disasembling and preferably comprises a hole where an element resisting to shearing stress can be inserted and locked; many different solutions are available according to known techniques but, being an important saftey problem that every railway operating organization will most probably solve in its own way, no particular solution is stressed in this text and therefore these devices are never shown in the figures.

There can be any suitable number of different models of cross supports 12, according to the requirements of the different models of freight wagons 10; two of them are particularly important:

- a cross support **12*a* providing a reverse enlarged T cross section 25 and depending rectangular end plates 26**, sometimes equipped with swivelling stanchions, adapted to form the holding frame of a flat wagon;
- a cross support **12*b* of the same shape but also providing at both its ends H-beam standards 27**, adapted to form the holding frame of high sided and covered wagons.

By way of example, FIG. 2 outlines a cross support **12*a* placed on an underframe 11 and a cross support 12*b* ready to be placed on it. Both are formed by a beam 22 of reverse enlarged T cross section 25 providing depending rectangular end plates 26 and depending extensions 21 ending with bevelled surfaces 24 adapted to fit on a pair of guides 20 of said underframe; for simpicity in this figure and in the following ones said extensions 21 are drawn in rectangular cross section, but in real use, as is immediately apparent to those skilled in the art, more complex shapes could be better. The cross support 12*b* provides also at its ends two vertical H-beam standards 27**.

A carrying element 13 is a structure designed to hold a stated load and transferring it directly to the underframe 11; every carrying element 13 must provide a lower bearing surface 28 mating with the upper surface 19 of said underframe 11 and two bevelled depending flanges 29 for each module of its length adapted to position and secure it both transversely against said underframe 11 itself and axially against the outer surfaces 30 of the guides 20.

There can be ay suitable number of different models of carrying elements 13, according to the requirements of the different models of freight wagons 10; one of them is particularly important, the floor element **13*a*. A floor element 13*a* is basically a rectangular platform, normally a module long, providing along each outer border a profiled extension 31 where side panels 14 can be fitted on and along each inner border a profiled flange 32 adapted to overlap the lateral reduced section of a beam 22 of a cross support 12, for instance 12***a* or 12*b*.

Some models of wagons can be implemented assembling only cross supports 12 and carrying elements 13 on an underframe 11; in such cases safety devices securing said carrying elements 13 to said cross supports 12 must be provided; in all other cases this safety function is performed through the side panels 14.

By way of example FIG. 3 outlines an underframe 11 and, placed on it, two cross supports 12*c* providing upper standards 33 adapted to hold a carrying element 13*b* ready to be placed on them; said carrying element 13*b*, eventually a hopper a module long which can be charged on top through an opening port 34 and discharged by gravity through an outlet 35, rests on two bearing extensions 36 providing a lower surface 28 mating with the upper surface 19 of said underframe 11 and two bevelled depending flanges 29 positioning it against the outer borders of the H-beams 17 and against the outer borders 30 of the guides 20 of said underframe 11; said carrying element 13*b* provides also four grooves 37 adapted to mate with the standards 33 of said cross supports 12*c*; said standards 33 and carrying element 13b must provide locking means as safety devices, not shown, adapted to prevent unwanted disassembling.

The side panels 14 are basically structures always locked to carrying elements 13, linking them to cross supports 12. Every side panel must provide, parallel to its lower inner border, a profiled groove 38 adapted to mate with one or more extensions 31 of carrying elements 13, for instance floor elements 13*a* and provide also, at both ends of said groove 38, rectangular vertical flat flanges 39 mating with half end plates 26 of cross supports 12, for instance 12*a* or 12*b*; if said side panels 14 are longer than one module, they must provide also a similar plate 40 for each cross support 12, which they rest on. Said plates 39 and 40 must embody means to house a safety device securing them to their mating plates 26, so preventing unwanted disassembling.

There can be any suitable number of different models of side panels 14, according to the requirements of the different models of freight wagons 10; said side panels 14 can be one or more modules long; they can range from a grooved beam, bearing or not upper folding flaps, as used to assemble a flat wagon, to blind wall elements for sided or covered wagons, to frameworks housing swing or sliding doors, and so on.

When vertically extended, said side panels 14 normally provide along their vertical borders T-profiled grooves 41 adapted to be fitted on mating standards of cross supports 12, for instance half H-beam standards 27 of cross supports 12*b*.

In the assembling operation, two or more of said side panels 14 are fitted horizontally through the coupling extension 31—groove 38 on one or more carrying elements 13 and then the assembled set is placed on vertically on an underframe 11 alrady bearing the cross supports 12; this operation is over when, centered by its bevelled depending flanges 29, the lower surface of said carrying element, or elements, 13 mates with the upper surface 19 of said underframe 11 and therefore the plates 39 and 40 of said side panels 14 mate with the end of the coupling standard 27—grooves 41 and, when it is over, also the profiled flanges 32 of said floor elements 13*a* mate with the reduced lateral part of the beams 22 of the cross supports 12*b*.

Of course the reverse sequence of operations is to be performed in the dissembling operations.

By way of example FIG. 4 outlines two side panels 14*a*, adpated to assemble a high sided wagon, providing horizontal inner T-profiled grooves 38, flat bands 39 and vertical T-profiled grooves 41 along their borders, during their fitting on a floor element 13*a* providing T-profiled extensions 31 and profiled flanges 32. The FIG. 5 outlines an underframe 11, two cross supports 12*b* placed on it and also the assembled set of FIG. 4 ready to be placed thereupon. The FIG. 6 shows a transverse cross section of said set of FIG. 4 placed on said underframe 11, while the FIG. 7 shows a horizontal cross section of the same assembly.

An end panel 15 is a transverse structure secured to a cross support 12; it must provide, parallel to its inner vertical borders, two grooves 41 mating with the standards of the cross support 12 which it is secured to, for instance standards 27 of a cross support 12*b* and provide also lateral flat vertical flanges 39 mating with half end plates 26 of said cross support 12; to the same cross support 12 are also normally secured two side panels 14; also in this case a safety device locking the mating place 39 and 26 must be provided.

There can be any suitable number of different models of end panels 15, according to the requirements of the different models of freight wagon 10.

By way of example FIG. 8 outlines a terminal section of an underframe 11, a cross support 12*b* placed on it and an end panel 15*a*, adapted to assemble a high sided wagon, providing vertical grooves 41 and lateral plates 39, ready to be fitted on it too.

To withstand the heavy axial thrusts sometimes present in some freight wagons, it is better to merge a cross support 12 and an end panel 15 in a single component, an end element 42; said end element 42 must provide a lower bearing surface 23 mating with the upper bearing surface 19 of an underframe 11, depending extensions 21 ending with bevelled surfaces 24 mating with a pair of guides 20 of said underframe 11 and lateral plates 43, each one equal to half plate 26, adapted to mate with plates 39 of side elements 14, complete with locking devices as above.

There can be any suitable number of models of said end elements 42, according to the requirements of the different models of freight wagons 10; when vertically extended, said end element 42 must provide also, along their inner outer borders, vertical extensions 44 shaped, in profile and position, exactly like half standards of the cross supports 12 with which said end element 42 is assembled, for instance standards 27 of cross supports 12*b*.

By way of example FIG. 9 shows the end element 42*a* corresponding to the merging of the assembly shown in FIG. 8; said end element 42*a* provides bearing surfaces 23 and extensions 21 with bevelled ending surfaces 24; its body can be thought of as two longitudinal half parts connected together: one shaped as half cross support 12*b*, that is a beam shaped as half profile 25 ending with two plates 43, and vertical profiled extensions 44 spaced assembly of the other elements. There can be any suitable number of different models of roof panels 16, according to the requirements of the different models of freight wagons 10; they can be shaped as fixed or removable roofs, frameworks housing sliding roofs, and so on.

They can be implemented, placed and secured completely with known techniques, and therefore no special description or figure is given.

FIGS. 10 and 11 show how a freight wagon 10*b*, eventually a four module long covered wagon with sliding walls, is assembled. The FIG. 10 shows an underframe 11*b* four modules long bearing the holding frame of said wagon 10*b*: one central cross support 12*b*, two lateral cross supports 12*d* providing only one standard 27, two end elements 42*b*. Then two equal sets of carrying elements 13 and side panels 14 are assembled and specularly placed side by side on said underframe 11*b*. Each set is formed by: two floor elements 13*a*, one two modules long side panel 14*b*, which is a framework housing a sliding door 46, and side panels 14*c* a module long, which are blind walls providing rails for the sliding door. Four roof panels one module long 16*a* are then placed on top of the assembly. The FIG. 11 outlines the assembled wagon with an opened door.

It is immediately apparent that the proposed system becomes more useful with fewer different building blocks involved, in particular the width of said wagons 10 should be standardised, possibly to only one measure. The standardisation of said building blocks is very important to reduce their overall number, their production cost and to simplify stocking.

On the other and it is immediately apparent that, if useful, many new models of freight wagons can be implemented either assembling differently sets of existing elements or designing new special purpose ones. In particular, the end panels 15 and the end elements 42 can be placed in every pair of guides 21 of any particular underframe 11, and it is always possible to assemble on it two or more different structures, so far as said underframe 11 is long enough.

As previously seen, all the operations involved in the assembling and disassembling of said building blocks are carried out by performing only one axis movement which are very easy to implement with automated devices; the generalised use of bevelled plugging parts can greatly simplify these operations, as immediately apparent to those skilled in this field.

It is also clear that the potential of the present invention is much wider that outlined in this text; in particular means of transport other than railway systems can use this same system.as immediately apparent to those skilled in this field.

I claim:

1. An assemblable freight wagon for use in a system of wagons comprising in use when assembled.

a. a skeletal underframe, b. coupling gear and wheeled running gear fitted to said underframe, c. a superstructure removably mounted on said underframe and adapted for carrying a specific type of goods, d. said underframe including at least one axial beam, e. a horizontal upper surface of said underframe defining a modular bearing pattern which is unified with respect to other wagons of said system of wagons in the sense that the modular dimensions, but not necessarily the number of modules per wagon, are the same, and f. an assembly of building blocks together comprising said superstructure and selected from a set of building blocks of corresponding modular dimensions, there being a plurality of species of building blocks and sets of congruent building blocks of each species, whereby the underframe is usable with alternative superstructures adapted for carrying alternative types of goods and which alternative superstructure are assemblable from alternative selections and combinations of building blocks wherein the set from which the building blocks are selected includes a range of alternative modular cross supports, carrying elements, side panels, end panels and end elements, and roof panels.

2. A wagon as in claim 1 wherein the underframe includes pairs of vertical guides spaced longitudinally at modular pitch and wherein each cross support includes a beam adapted to rest transversely on the underframe and further includes two depending extensions mating with the paired vertical guides on opposite sides of the underframe such that the cross supports and the underframe are brought into and out of engagement with one another by vertical relative movement.

3. A wagon as in claim 2 wherein the depending extensions are profiled to faciltate insertion into the guides.

4. A wagon as in claim 2 including locking means operative between the extensions and the underframe.

5. A wagon as in claim 1 wherein the cross supports embody a beam of enlarged reverse T cross section and rectangular vertical flat end plates, and provide also, at least at one end a vertical H-beam standard.

6. A wagon as in claim 1 wherein the carrying elements are structures of a particular shape adapted for carrying a particular load and transferring its weight directly to the underframe, the carrying elements having lower bearing surfaces mating with the upper bearing surface of the underframe and two tapered depending flanges for each module of their length adapted to position and secure them both transversely against the underframe and axially against the outer surfaces of adjoining pairs of guides.

7. A wagon as in claim 6 wherein the carrying element is provided with fitting means to mate with corresponding support means of the cross supports.

8. A wagon as in claim 7 wherein said carrying element is a floor element, basically a rectangular platform normally a module long, providing along each outer border a profiled extension whereupon side panels can be fitted and along each inner border a profiled flange adapted to overlap with laterally reduced parts of beams of cross supports.

9. A wagon as in claim 1 wherein the side panels are structures at least one module long shaped in a particular adaptation, being locked to carrying elements linking them to cross supports, providing parallel to their lower inner border a profiled groove adapted to mate with the profiled extensions of said carrying elements and at its ends two rectangular vertical flat plates each mating with a half plate of said cross supports and also providing, if more than one module long, for each intermediate cross support, which they rest on, a similar plate mating with the end plates of said cross supports, embodying in each pair of said mating plates means adapted to house a locking device, to thereby provide a locking means.

10. A wagon as in claim 9 wherein said side panels provide, along their vertical outer borders, grooves adapted to be fitted on half standards of cross supports.

11. A wagon as in claim 1 wherein the end panels are transverse structures shaped for a particular adaptation locked to a cross support, providing along their inner outer borders grooves adapted to be fitted on standards of cross supports and providing also vertical rectangular flat plates mating with half end plates of said cross supports and embodying in each pair of said plates means adapted to house a locking device.

12. A wagon as in claim 1 wherein the end elements are transverse structures forming an end of the wagon and differently shaped according to its model, embodying in said end element and merged fundmental features of a cross support and an end panel fitted on it, so providing a lower bearing surface and depending extensions, respectively mating with the upper bearing surface and a pair of guides of said underframe, lateral plates mating with the end plates of side panels, embodying in each pair of said plates means adapted to house a locking device, and mostly providing also parallel to their inner outer borders, vertical profiled extensions mating with grooves of the side panels.

13. A wagon as in claim 1 wherein said roof panels are covers shaped for a particular adaptation, placed and locked with known techniques.

14. A wagon as in claim 1 further comprising reversible joints and reversible fittings with bevelled profiles to facilitate their insertion and whose assembling and disassembling operations follow an ordered sequence of one axis movements adapted be performed easily by automated systems.

15. A wagon as in claim 1 wherein all said building blocks are normally standardized so as to be mass produced.

* * * * *